US006910600B2

(12) United States Patent
Keberlein

(10) Patent No.: US 6,910,600 B2
(45) Date of Patent: Jun. 28, 2005

(54) IN-LINE WINDOWED FACIAL TISSUE CARTON

(76) Inventor: Gerald J. Keberlein, W6344 Cedar Cliff Dr., Hortonville, WI (US) 54944

( * ) Notice: Subject to any disclaimer, the term of this patent is extended or adjusted under 35 U.S.C. 154(b) by 185 days.

(21) Appl. No.: 10/613,185

(22) Filed: Jul. 3, 2003

(65) Prior Publication Data

US 2004/0144795 A1 Jul. 29, 2004

Related U.S. Application Data

(60) Provisional application No. 60/442,218, filed on Jan. 24, 2003.

(51) Int. Cl.[7] ..... B65H 1/00
(52) U.S. Cl. ..... 221/33; 229/116.1
(58) Field of Search ..... 221/33, 45, 63; 229/116.1, 116.5; 206/457, 459.5

(56) References Cited

U.S. PATENT DOCUMENTS

| | | | | | |
|---|---|---|---|---|---|
| 1,181,781 | A | * | 5/1916 | Long | 229/126 |
| D76,634 | S | | 10/1928 | Riegel | 9/430 |
| 2,334,997 | A | | 11/1943 | Doll | 206/58 |
| 3,155,273 | A | | 11/1964 | Cote | 221/63 |
| D212,109 | S | | 8/1968 | Taylor | D44/6 |
| 3,428,235 | A | | 2/1969 | Randazzo | 229/40 |
| 3,940,054 | A | | 2/1976 | Goebel et al. | 229/51 |
| 4,044,889 | A | | 8/1977 | Orentreich et al. | 206/459 |
| 4,163,508 | A | | 8/1979 | Mannor | 221/310 |
| 4,200,200 | A | | 4/1980 | Hein, III et al. | 221/48 |
| 4,513,862 | A | | 4/1985 | Mallow | 206/233 |
| D280,703 | S | | 9/1985 | Strobe | D9/331 |
| D280,965 | S | | 10/1985 | Prophet, Jr. et al. | D7/81 |
| 4,623,074 | A | | 11/1986 | Dearwester | 221/48 |
| D293,058 | S | | 12/1987 | Iwarsson | D6/523 |
| 4,863,026 | A | | 9/1989 | Perkowski | 206/387 |
| D316,201 | S | | 4/1991 | Shimasaski | D6/518 |
| 5,219,421 | A | | 6/1993 | Tipping | 221/63 |
| D340,373 | S | | 10/1993 | Konkin | D6/518 |
| 5,280,385 | A | | 1/1994 | Wybrow | 359/438 |
| 5,294,040 | A | * | 3/1994 | Cohen et al. | 229/116.1 |

(Continued)

*Primary Examiner*—Kenneth Noland
(74) *Attorney, Agent, or Firm*—Whyte Hirschboeck Dudek SC

(57) ABSTRACT

Disclosed herein is a facial tissue container comprising: a top face having a plurality of top face portions, the top face portions for creating a facial tissue container opening; a bottom face disposed opposite the top face and having a plurality of bottom face portions; and a plurality of side faces in top-fold continuity with the top face and in bottom-fold continuity with the bottom face, the plurality of side faces creating a continuous decorative surface that extends in side-fold continuity across the side faces except at a facial tissue container side interface formed between two of the plurality of side faces. As a result, there is more continuity of packaging, and fewer glued sides. In this manner, any graphics on the package can continue unimpeded, without being aligned and glued, along the sides and up around the top to the window opening of the container. The container provides cleaner, uninterrupted graphics printed upon the container, resulting in a more dramatic and effective visual effect. Advantageously, the tissue container can be built with fewer construction materials because there are fewer flaps.

22 Claims, 6 Drawing Sheets

U.S. PATENT DOCUMENTS

| | | | | |
|---|---|---|---|---|
| 5,375,713 | A | 12/1994 | Horvat et al. | 206/418 |
| 5,516,000 | A | 5/1996 | Freiburger et al. | 221/48 |
| 5,542,598 | A | 8/1996 | Capo | 229/242 |
| 5,544,741 | A | 8/1996 | Fantone et al. | 206/308.1 |
| D376,501 | S | 12/1996 | Spaseska | D6/518 |
| 5,740,913 | A | 4/1998 | McFarland | 206/494 |
| 5,823,344 | A | 10/1998 | Fantone et al. | 206/459.5 |
| 5,833,068 | A | 11/1998 | Fantone | 206/459.1 |
| 5,850,913 | A | 12/1998 | Fantone et al. | 206/308.1 |
| 5,941,382 | A | 8/1999 | Fantone et al. | 206/308.1 |
| D420,236 | S | 2/2000 | Parkes et al. | D6/515 |
| 6,065,623 | A | 5/2000 | Hierzer et al. | 215/230 |
| 6,158,614 | A | 12/2000 | Haines et al. | 221/63 |
| D439,515 | S | 3/2001 | Rondolino | D9/430 |
| 6,213,345 | B1 | 4/2001 | Plank | 221/46 |
| 6,278,545 | B1 | 8/2001 | Napier | 359/440 |
| 6,279,775 | B1 | 8/2001 | Parkes et al. | 221/63 |
| 6,318,590 | B1 | 11/2001 | McMurray-Stivers | 221/45 |
| 6,366,401 | B1 | 4/2002 | Gonda et al. | 359/440 |
| 6,381,887 | B1 | 5/2002 | Williams | 40/454 |
| 6,385,882 | B1 | 5/2002 | Conley et al. | 40/454 |
| D459,221 | S | 6/2002 | Springer et al. | D9/416 |
| D462,212 | S | 9/2002 | Kureghian | D6/515 |
| D463,976 | S | 10/2002 | Sipinen et al. | D9/339 |
| 2002/0000444 | A1 | 1/2002 | Bliss | 220/628 |

* cited by examiner

FIG. 1
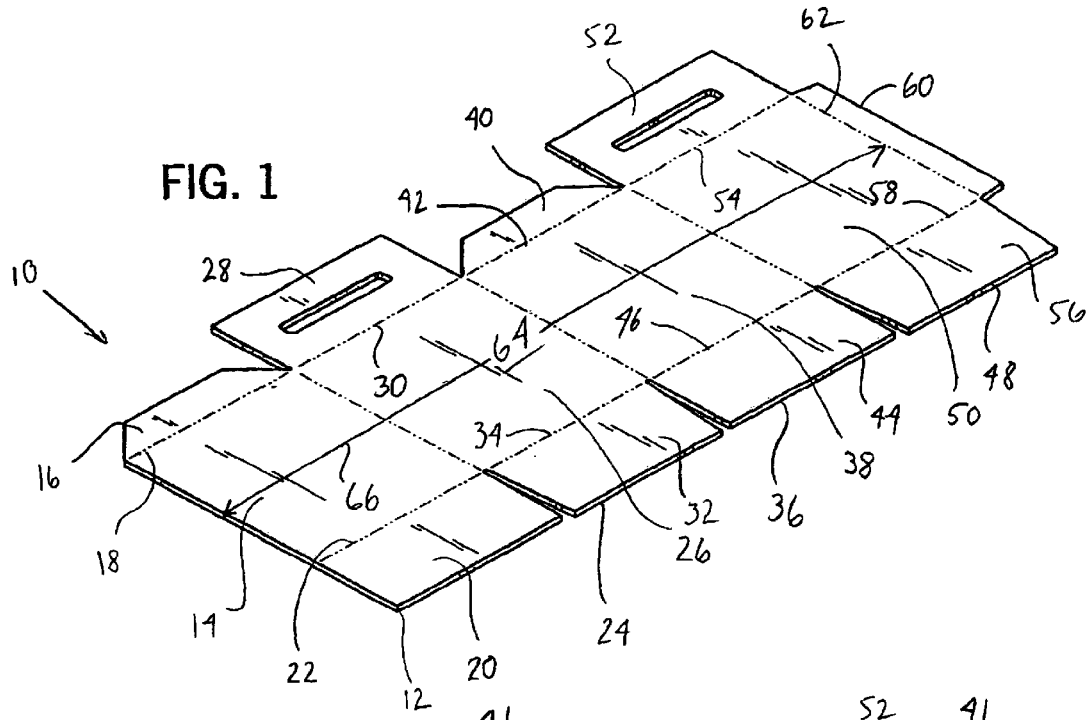
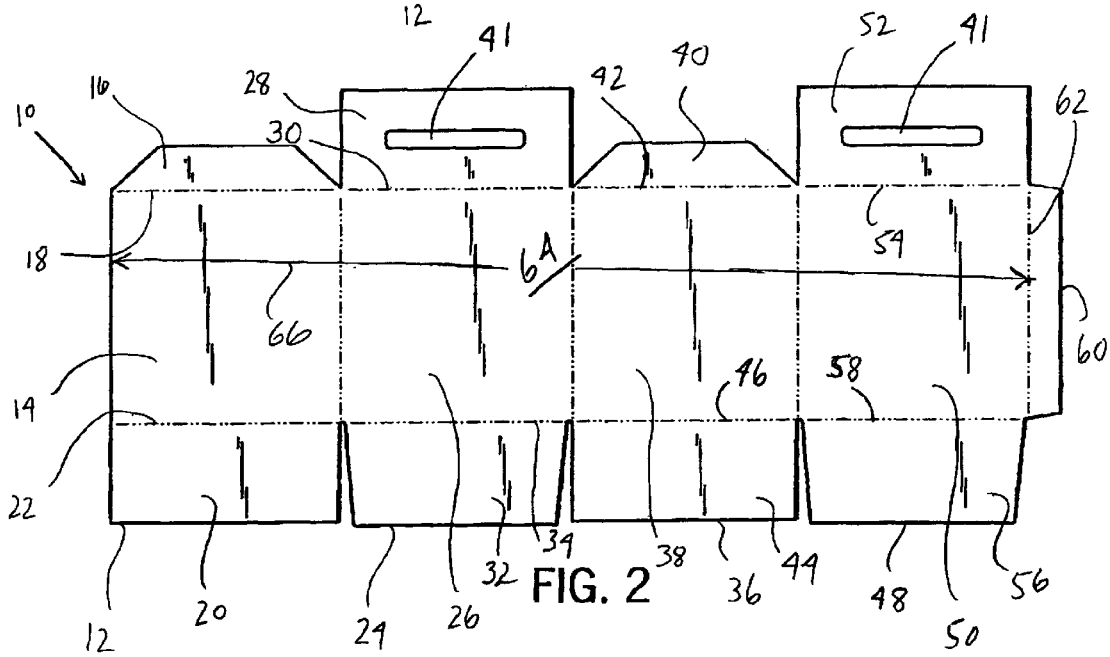
FIG. 2

FIG. 3
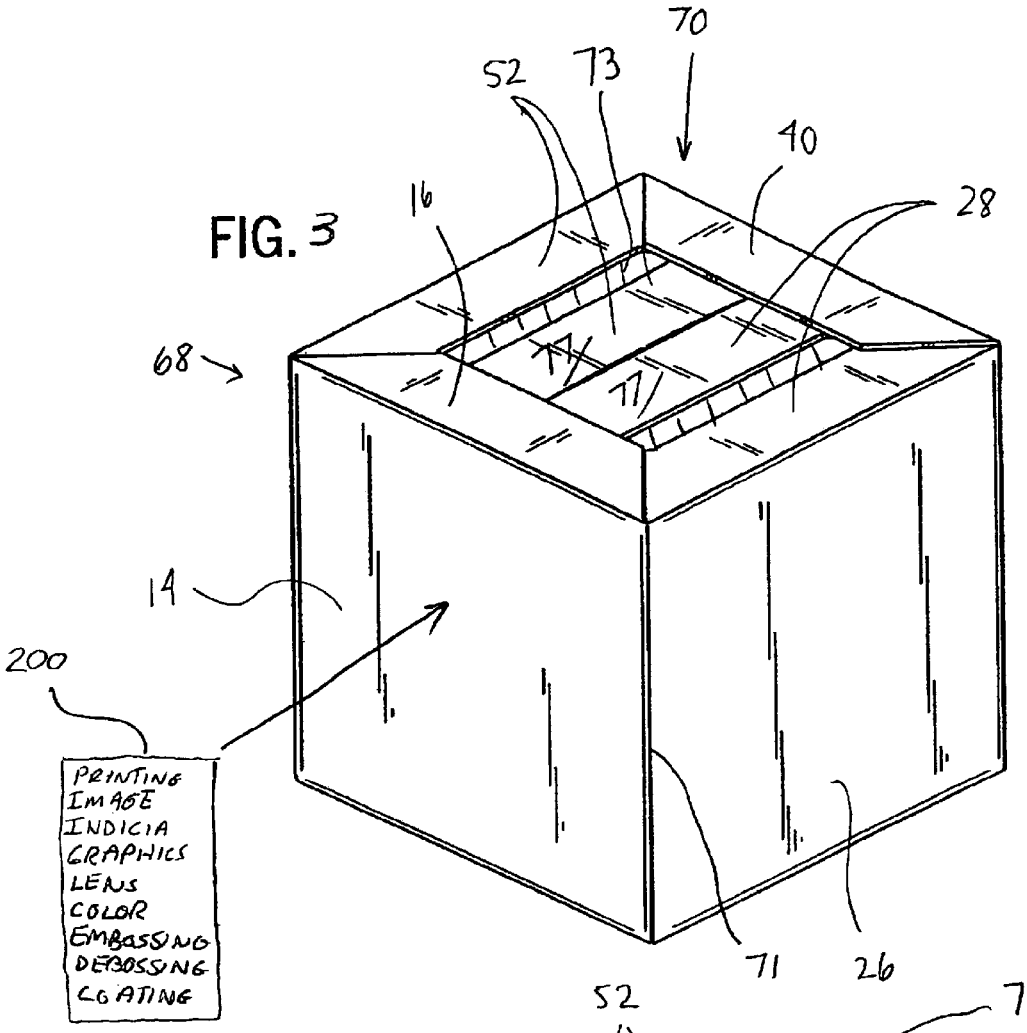
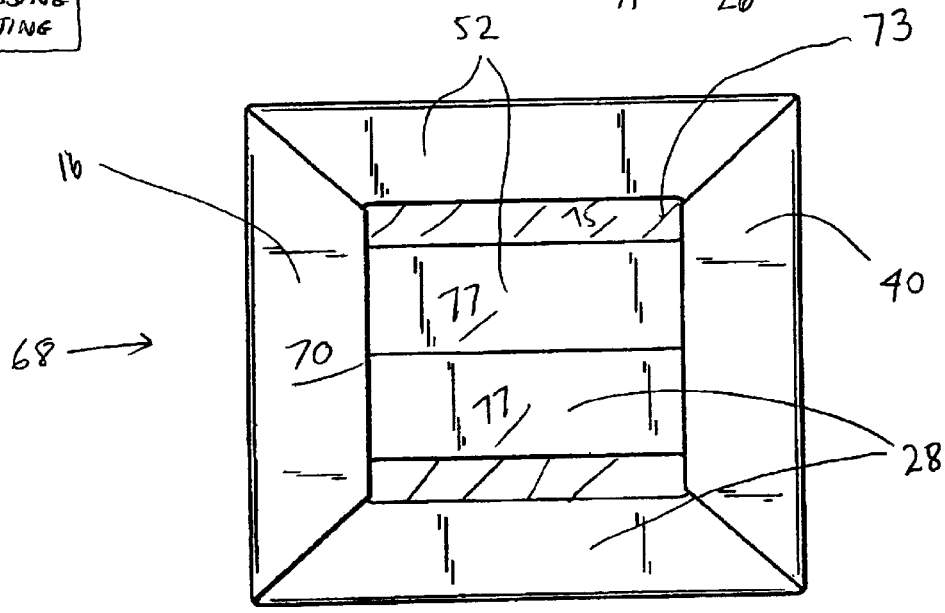
FIG. 4

IN-LINE WINDOWED FACIAL TISSUE CARTON

CROSS REFERENCE TO RELATED APPLICATION

This application is related to Provisional Application No. 60/442,218 filed with the United States Patent and Trademark Office on Jan. 24, 2003.

FIELD AND BACKGROUND OF THE INVENTION

The invention relates generally to a tissue container, and more particularly, to a tissue container having a face and tab configuration that increases visible edge continuity and decreases edge alignment and flap requirements, and including a windowing material that is applied as part of an inline web printing process.

Increasingly, producers of consumer use product containers are making maximum use of the container surface area through the use of full face graphics, specialized graphics, including three dimensional, lenticular, holographic, laminated films, foils and other printed, photographic and digital effects. The increased use of such graphics creates a desire for the minimization of visible boundaries at the meeting point of edges to maximize the visual effect of the printed graphics.

Also, in the manufacturing of containers, or any other die cut process, the savings of material in the overall blank in order to accomplish the same construction is a continuing design goal. The savings in material corresponds to a direct savings in manufacturing costs, and more efficient production. It is highly desirable to have a container construction scheme that decreases the amount of container material required to construct a container having the same functionality.

Moreover, the process of applying windowing material to a tissue container, for example, generally requires a several staged process by which the container blank is printed separately from the windowing application process. A need exists to incorporate the application of the windowing material to the container as part of the printing process when printing in an inline web format. The combination of these steps in a single process reduces time and labor involved in the creation of the tissue container.

BRIEF SUMMARY OF THE INVENTION

Disclosed herein is a facial tissue container. The container comprises a top face comprising a plurality of top face portions, the top face portions for creating a facial tissue container opening; a bottom face disposed opposite the top face and comprising a plurality of bottom face portions; and a plurality of side faces in top-fold continuity with the top face and in bottom-fold continuity with the bottom face, the plurality of side faces creating a continuous decorative surface that extends in side-fold continuity across the side faces except at a facial tissue container side interface formed between two of the plurality of side faces.

Also disclosed is a tissue container comprising: a first section having a first section decorative portion, a top flap portion disposed at a first end of the first section decorative portion and a bottom flap portion disposed at a second end of the first section decorative portion; a second section connected to the first section, the second section having a second section decorative portion, a top flap portion disposed at a first end of the second section decorative portion and a bottom flap portion disposed at a second end of the second section decorative portion; a third section connected to the second section, the third section having a third section decorative portion, a top flap portion disposed at a first end of the third section decorative portion and a bottom flap portion disposed at a second end of the third section decorative portion; a fourth section connected to third section, the fourth section having a fourth section decorative portion and a top flap portion disposed at a first end of the fourth section decorative portion and a bottom flap portion disposed at a second end of the fourth section decorative portion; and a tab portion connected to a third end of the fourth section decorative portion, the tab portion for securing in overlapping fashion the fourth section decorative portion to the first section decorative portion; wherein top flap portions form a tissue container top face and define an opening in the top face, the bottom flap portions form a tissue container bottom face, and the first, second, third and fourth section decorative portions form a continuous decorative surface.

Also disclosed herein is a blank for construction of a facial tissue container.

Other aspects, embodiments, alternatives, objects and advantages will become apparent upon a reading of the detailed description that follows.

BRIEF DESCRIPTION OF THE DRAWINGS

The drawings illustrate the best mode presently contemplated for carrying out the invention.

In the drawings:

FIG. 1 is a perspective view of a blank of a tissue container in accordance with one embodiment of the present invention;

FIG. 2 is a top plan view of the blank of FIG. 1;

FIG. 3 is a perspective view of a tissue container formed from the blank of FIG. 1;

FIG. 4 is a top plan view of the tissue container of FIG. 3 in accordance with one aspect of the present invention;

DETAILED DESCRIPTION OF THE INVENTION

Figure 5:
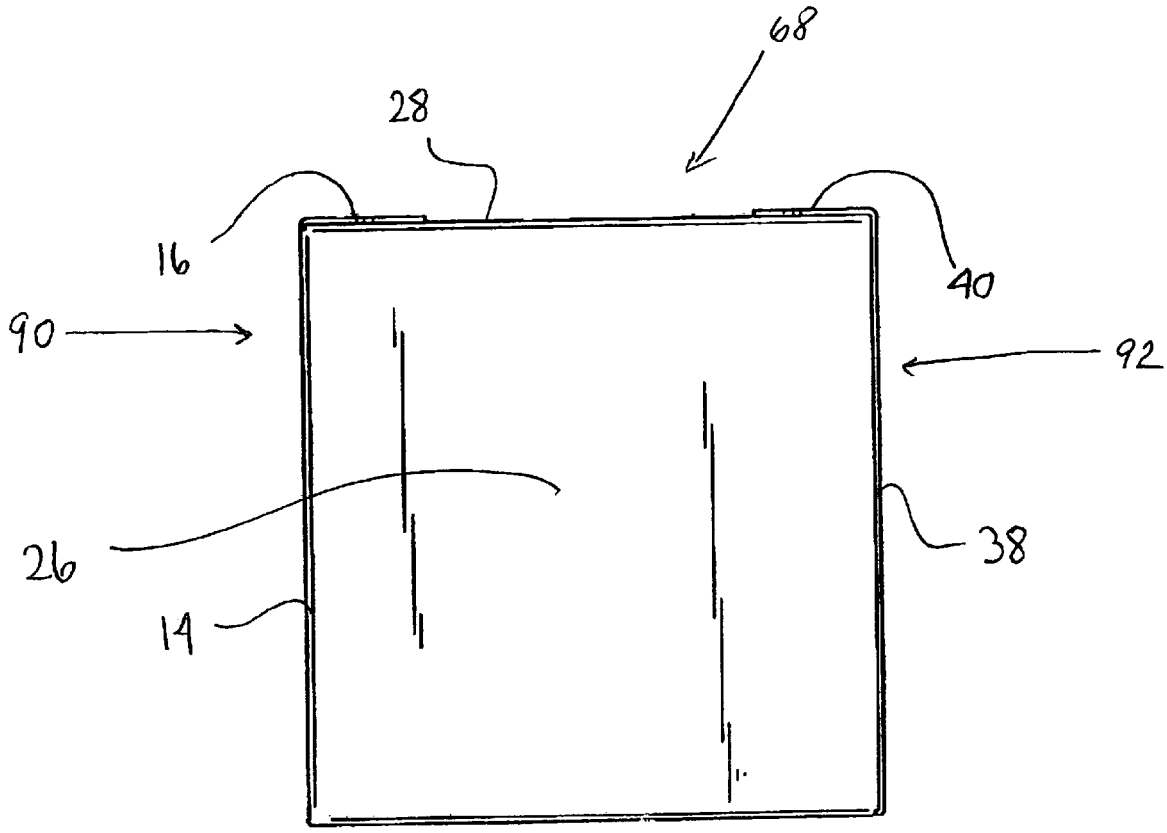
FIG. 5 is a side elevational view of the tissue container of FIG. 3 in accordance with one aspect of the present invention.

FIGS. 1 and 2 are a perspective and top plan views, respectively, of a blank, generally indicated by the numeral 10 for a tissue container in accordance with one embodiment of the present invention. The blank 10 comprises a first section 12 having a first section decorative portion 14, a top flap portion 16 disposed at a first end 18 of the first section decorative portion and a bottom flap portion 20 disposed at a second end 22 of the first section decorative portion. Blank 10 further comprises a second section 24 connected to first section 12, the second section having a second section decorative portion 26, a top flap portion 28 disposed at a first end 30 of the second section decorative portion and a bottom flap portion 32 disposed at a second end 34 of the second section decorative portion. The blank 10 still further includes a third section 36 connected to second section 24, the third section having a third section decorative portion 38, a top flap portion 40 disposed at a first end 42 of the third section decorative portion and a bottom flap portion 44 disposed at a second end 46 of the third section decorative portion. The blank 10 still further includes a fourth section 48 connected to third section 36, the fourth section having a fourth section decorative portion 50 and a top flap portion 52 disposed at a first end 54 of the fourth section decorative portion and a bottom flap portion 56 disposed at a second end 58 of the fourth section decorative portion. Finally, blank 10 includes a tab portion 60 connected to a third end 62 of the fourth section decorative portion 50. Tab portion 60 is utilized to secure, in overlapping fashion, the fourth section decorative portion 50 to the first section decorative portion 14 in constructing a facial tissue container that can be made from blank 10. In one embodiment, first section and third section top flap portions 16 and 40 are truncated triangular in shape. Further, in one embodiment, second section top flap portion 28 and the fourth section top flap portion 52 are rectangular and further include a slot 41.

Significantly, the first, second, third and fourth section decorative portions form a continuous decorative surface 64, as indicated by line 66. Continuous surface 64 is referred to as a continuous decorative surface in that it can receive vector or graphic art in, for example, printed form, to maximize a visual effect to a consumer. Advantageously, by spanning across several container portions, the continuous decorative surface eliminates printing problems that typically occur or result at discontinuous boundaries. As a result, blank 10 having continuous decorative surface is well-suited for use in an in-line printing environment.

FIGS. 3 and 4 show a perspective view and a top plan view, respectively, of tissue container 68 that can be formed from blank 10 of FIG. 1. More specifically, shown are first section decorative portion 14 and second section decorative portion 26, second section top flap portion 28, fourth section top flap portion 52, first section top flap portion 16, and third section top flap portion 40. Significantly, the top flap or face portions form a tissue container top or top face 70. In the completed container 68, portions 14 and 26 are folded so as to be in side fold continuity across edge 71, and by this it is meant that there is a continuity of material (which used to create or form the continuous decorative surface described previously). The top flap portions define a tissue container opening 75 which can be spanned by a windowing material 73, which can comprise a flexible thin plastic film. The plastic film can be attached to either the inside or outside surfaces of the container top. The plastic film can contain a dispensing opening formed therein. The dispensing opening can be a single slit or it can take on various cross or x-shaped configurations. Advantageously, the plastic film is applied to the container in-line as part of the printing operation.

The tissue container further comprises removable perforated portions 77 that cover at least a portion of the tissue container opening. The decorative portions can also be referred to as side faces. Significantly, the exterior of the container, and in particular the continuous decorative surface, is particularly well-suited for receiving commercially suitable decoration, such as image, print, indicia, graphics, fresnel lens, lenticular lens, color, an embossed area, a debossed area, and coating(s).

FIG. 5 is a side elevational view of the tissue container of FIG. 3 in accordance with one aspect of the present invention. Shown are first section decorative portion 14, second section decorative portion 26 and third section decorative portion 38, as well as first section top flap portion 16 and third section top flap portion 40. The manner in which completed container 68 is folded is an important aspect of the present invention. By folding the container 68 such that flap portion 16 folds into first section decorative portion 14, and similarly, decorative portion 40 folds into third section decorative portion 38, continual unbroken surfaces 90 and 92 are created. The result is that any printed material on this surface will be more visually distinct, and not choppy nor broken, so as to enhance the visual experience of the user. Continual surfaces 90 and 92 are in side fold continuity about second section top flap portion 28 and fourth section top flap portion 52 (FIGS. 3–4) to create container top 70.

Figure 6:
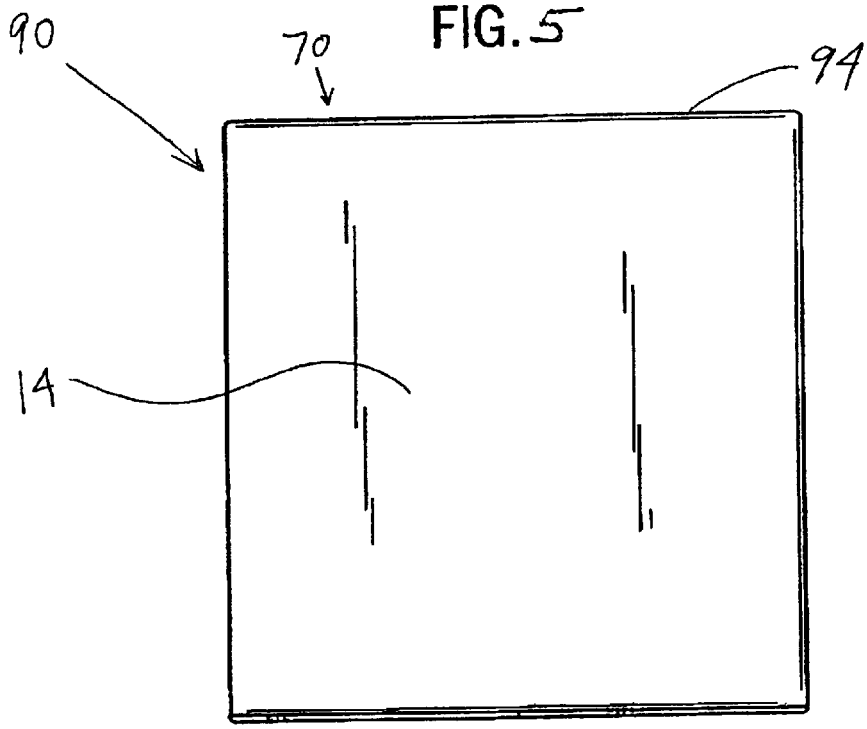
FIG. 6 is a front elevational view of the tissue container of FIG. 3 in accordance with one aspect of the present invention.

FIG. 6 is a front elevational view of the tissue container of FIG. 3 in accordance with one aspect of the present invention and illustrating one of the continuous faces. The side fold continuity of FIG. 5 presents itself in side 14 in that the entire face is visible, without any glued or otherwise secured joints or edges. In addition, the side are folded to form part of top 70, again without any discontinuity along edge 94, again illustrating top fold continuity.

Figure 7:
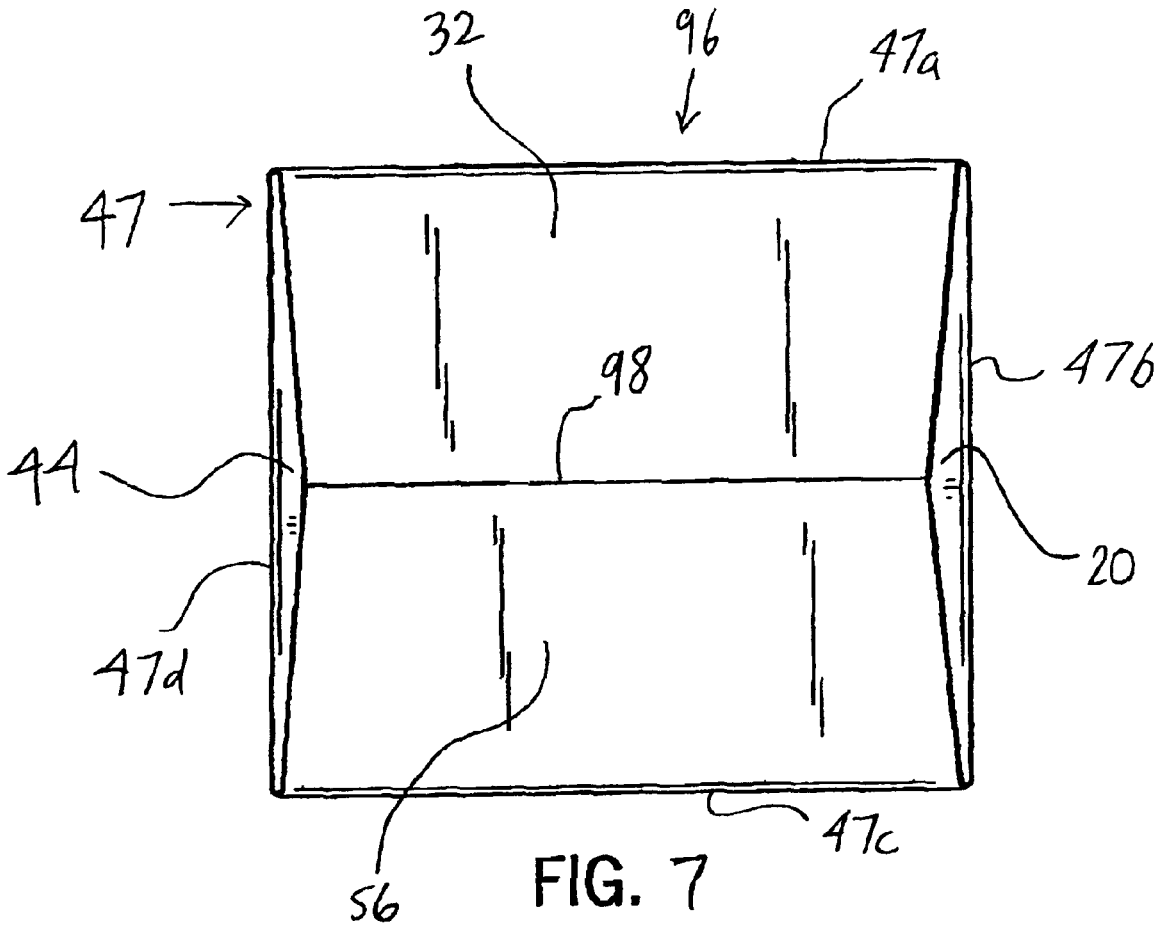
FIG. 7 is a bottom view of the tissue container of FIG. 3 in accordance with one aspect of the present invention.

FIG. 7 is a bottom view of the tissue container of FIG. 3 in accordance with one aspect of the present invention. Second and fourth section bottom flap or face portions 32 and 56 are folded around first and third section bottom flap portion 20 and 44 to create tissue container bottom or bottom face 96. A seam 98 formed by the folding and joining of bottom flap portions 32 and 56 is visible, however, this is not detrimental to the overall aesthetic appearance of the container to a user since the seam is formed in the container bottom 96, which is typically not seen in a point of purchase display. As such, the bottom 96 can be said to be in bottom fold continuity because there are not discontinuous along a perimeter 47 defined by edges 47*a–d*.

Figure 8:
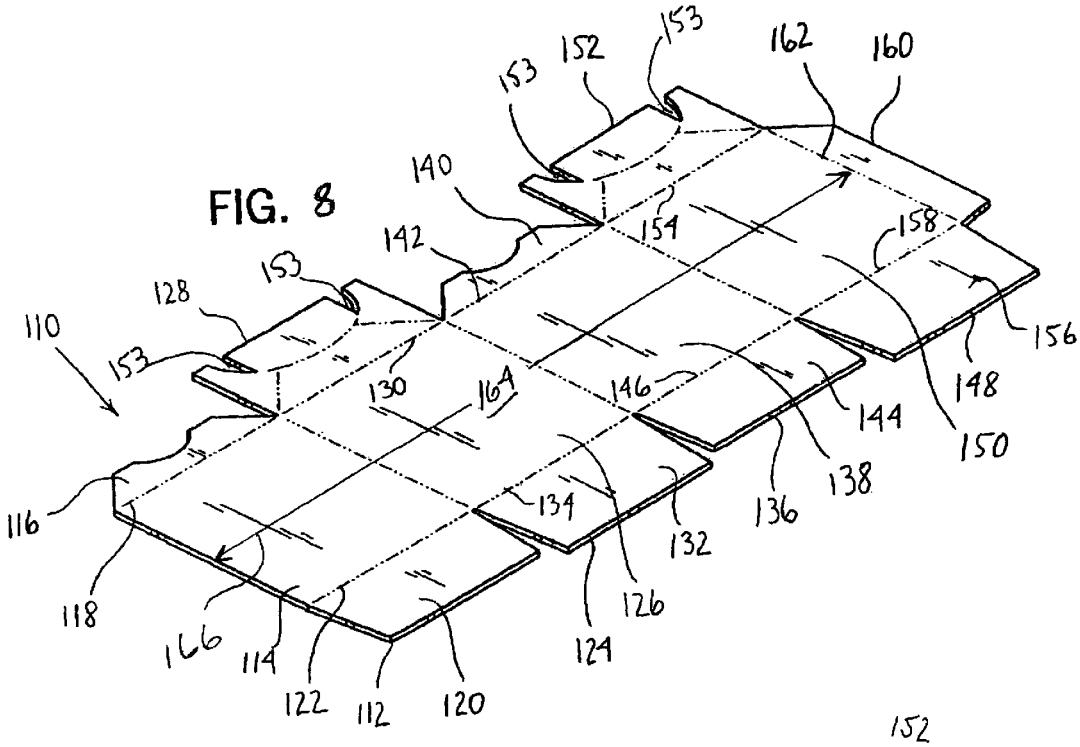
FIG. 8 is a perspective view of a blank of a tissue container in accordance with one embodiment of the present invention.
Figure 9:
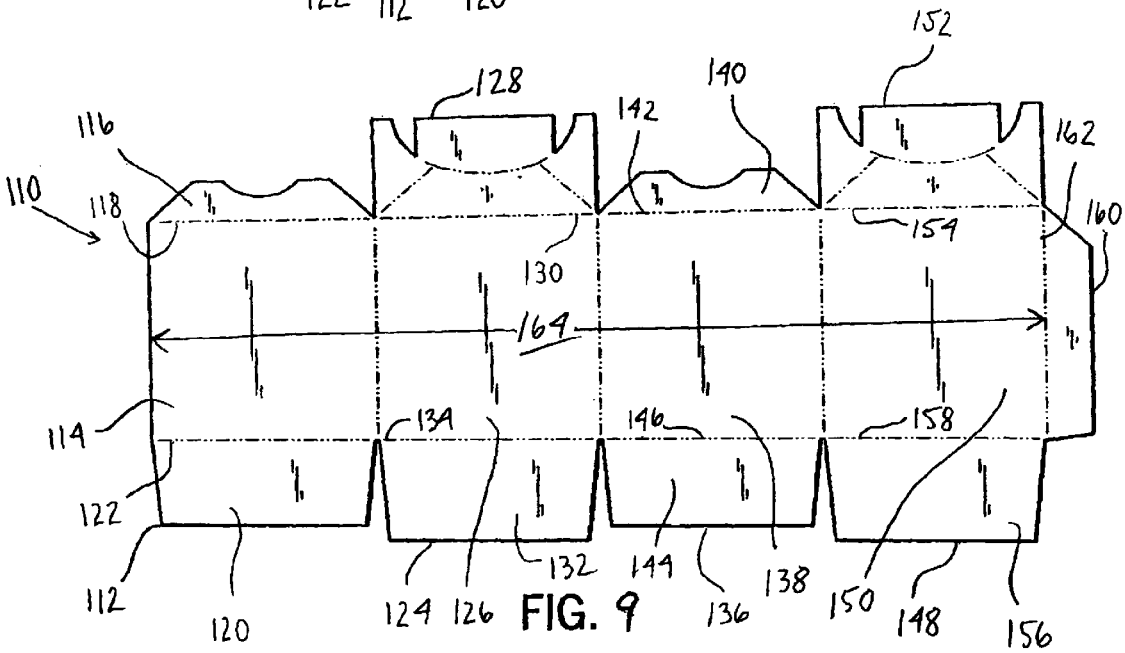
FIG. 9 is a top plan view of the blank of FIG. 8.

FIGS. 8 and 9 are perspective and top plan views, respectively, of a blank, generally indicated by the numeral 110 for construction of a tissue container in accordance with another embodiment of the present invention. The blank 110 comprises a first section 112 having a first section decorative portion 114, a top flap portion 116 disposed at a first end 118 of the first section decorative portion and a bottom flap portion 120 disposed at a second end 122 of the first section decorative portion. Blank 110 further comprises a second section 124 connected to first section 112, the second section having a second section decorative portion 126, a top flap portion 128 disposed at a first end 130 of the second section decorative portion and a bottom flap portion 132 disposed at a second end 134 of the second section decorative portion. The blank 110 still further includes a third section 136 connected to second section 124, the third section having a third section decorative portion 138, a top flap portion 140 disposed at a first end 142 of the third section decorative portion and a bottom flap portion 144 disposed at a second end 146 of the third section decorative portion. The blank 110 still further includes a fourth section 148 connected to third section 136, the fourth section having a fourth section decorative portion 150 and a top flap portion 152 disposed at a first end 154 of the fourth section decorative portion and a bottom flap portion 156 disposed at a second end 158 of the fourth section decorative portion. Finally, blank 110 includes a tab portion 160 connected to a third end 162 of the fourth section decorative portion 150. Tab portion 160 is utilized to secure, in overlapping fashion, the fourth section decorative portion 150 to the first section decorative portion 114 in constructing a facial tissue container that can be made from blank 110. In one embodiment, first section and third section top flap portions 116 and 140 have a notched truncated triangular shape. Further, in one embodiment, second section top flap portion 128 and fourth section top flap portion 152 are generally rectangular in shape and further include a plurality of notches 153 so as to be "double notched".

Here, the first, second, third and fourth section decorative portions form a continuous decorative surface 164, as indicated by line 166. As before, continuous surface 164 is referred to as a continuous decorative surface, and by spanning across several container portions, the continuous decorative surface again eliminates various printing problems that typically occur or result at discontinuous boundaries. Blank 110 is also well-suited for use in an in-line printing environment.

Figure 10:
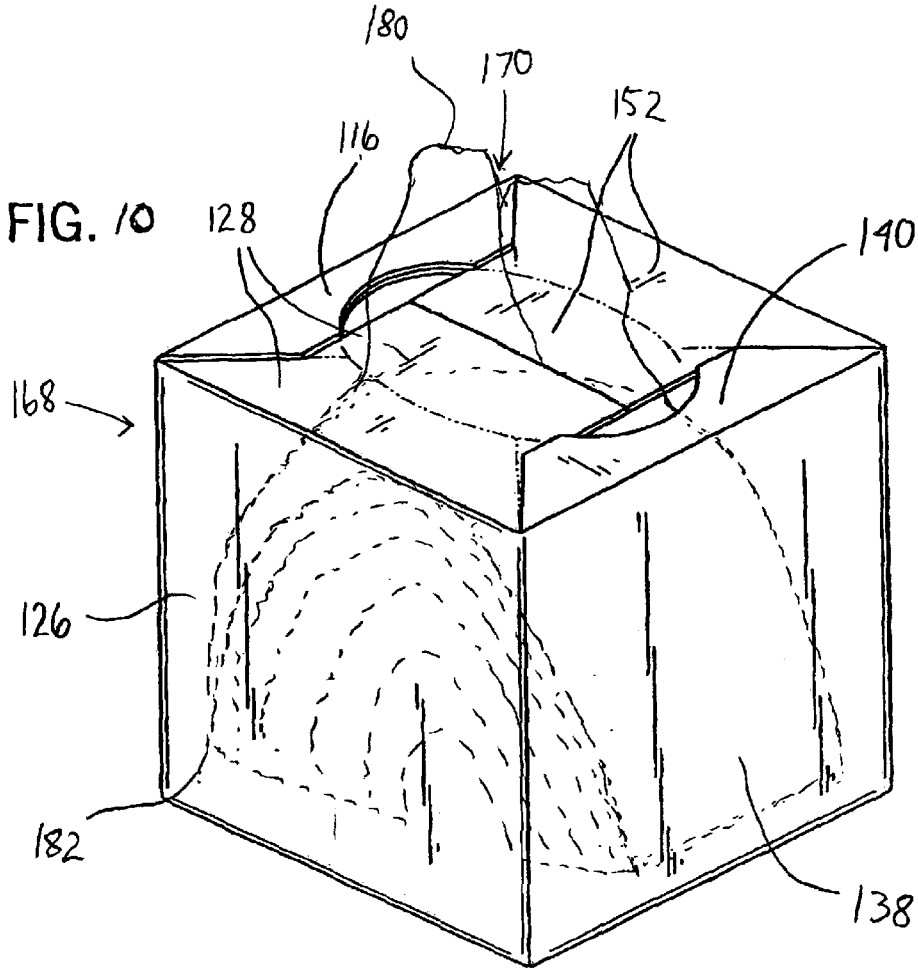
FIG. 10 is a perspective view of a tissue container formed from the blank of FIG. 8.
Figure 11:
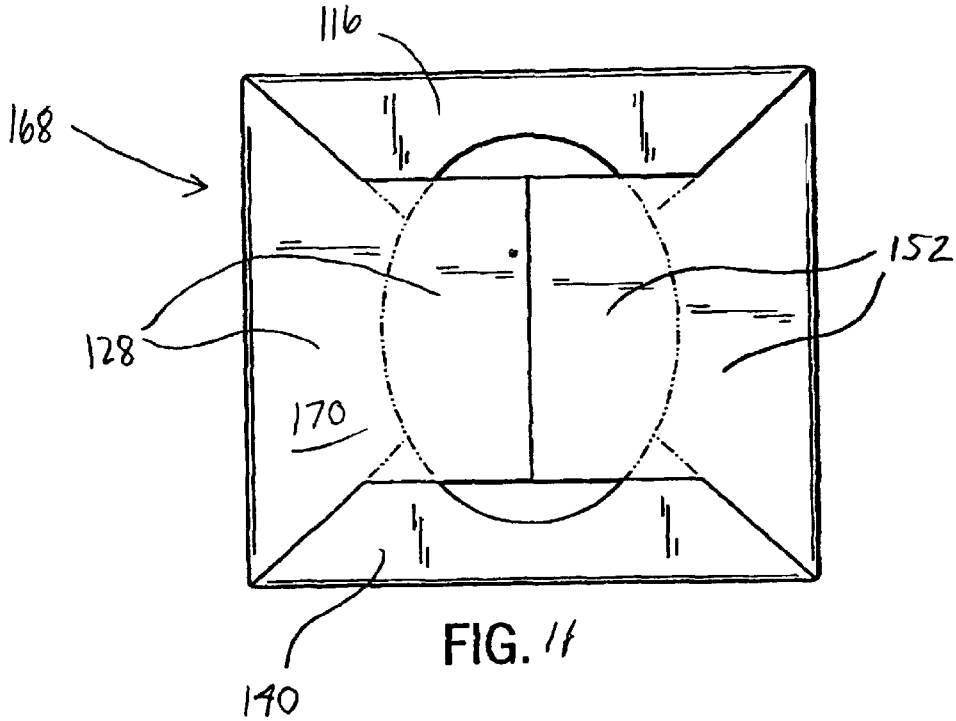
FIG. 11 is a top plan view of the tissue container of FIG. 10 in accordance with one aspect of the present invention.

FIG. 10 and FIG. 11 are perspective and top plan views, respectively, of a tissue container 168 formed from the blank of FIGS. 8 and 9. More specifically, shown are second section decorative portion 126, third section decorative portion 138, second section top flap portion 128, fourth section top flap portion 152, first section top flap portion 116, and third section top flap portion 140. Decorative portion 126 and top flap portion 128 illustrative top fold continuity. Significantly, the top flap portions form a tissue container top 170. In the completed container 168, the decorative portions are folded so that they are in side fold continuity. Also shown are tissues 180, a plurality of which can be inserted in a known interleaved fashion, for example using a u-clip 182 of tissues. The perforated portions can be removed to create, for example, an oval or substantially rectangular tissue-dispensing opening. The tissue container is defined by a polyhedral body. As shown, the body is generally rectangular in shape or profile, however, it is to be understood that other shapes or profiles are contemplated and within the scope of the present invention.

The embodiments shown are exemplary in their depiction of the size (including section, portion, notch, slot and opening sizes) and relative proportions.

Advantageously, the tissue container can be built with fewer construction materials because there are fewer flaps.

The present invention has been described in terms of preferred embodiments. Equivalents, alternatives, and modifications, aside from those expressly stated herein, are possible and should be understood to be within the scope of the appending claims.

What is claimed is:

1. A tissue container comprising:

a first section having a first section decorative portion, a top flap portion disposed at a first end of the first section decorative portion and a bottom flap portion disposed at a second end of the first section decorative portion;

a second section connected to the first section, the second section having a second section decorative portion, a top flap portion disposed at a first end of the second section decorative portion and a bottom flap portion disposed at a second end of the second section decorative portion;

a third section connected to the second section, the third section having a third section decorative portion, a top flap portion disposed at a first end of the third section decorative portion and a bottom flap portion disposed at a second end of the third section decorative portion;

a fourth section connected to third section, the fourth section having a fourth section decorative portion and a top flap portion disposed at a first end of the fourth section decorative portion and a bottom flap portion disposed at a second end of the fourth section decorative portion; and a tab portion connected to a third end of the fourth section decorative portion, the tab portion for securing in overlapping fashion the fourth section decorative portion to the first section decorative portion;

wherein top flap portions form a tissue container top face and define an opening in the top face, the bottom flap portions form a tissue container bottom face, and the first, second, third and fourth section decorative portions form a continuous decorative surface.

2. The tissue container of claim 1 wherein the continuous decorative surface extends in side fold continuity across the decorative portions.

3. The tissue container of claim 1 wherein the first, second, third and fourth section decorative portions are in top fold continuity with the respective top flap portions and in bottom fold continuity with the respective bottom flap portions.

4. The tissue container of claim 1 wherein the top flap portions define a tissue container opening which is spanned by a windowing material.

5. The tissue container of claim 4 further comprising a removable perforated portion that covers at least a portion of the tissue container opening.

6. The tissue container of claim 1 in combination with a plurality of facial tissues.

7. A facial tissue container comprising:

a top face comprising a plurality of top face portions, the top face portions for creating a facial tissue container opening;

a bottom face disposed opposite the top face and comprising a plurality of bottom face portions; and a plurality of side faces in top-fold continuity with the top face and in bottom-fold continuity with the bottom face, the plurality of side faces creating a continuous decorative surface that extends in side-fold continuity across the side faces except at a facial tissue container side interface formed between two of the plurality of side faces.

8. The facial tissue container of claim 7 wherein one of the plurality of side faces is adjoined along a top edge to one of the plurality of top face portions of the top face.

9. The facial tissue container of claim 7 wherein one of the plurality of side faces is adjoined along a bottom edge to one of the plurality of bottom face portions of the bottom face.

10. The facial tissue container of claim 7 wherein the decorative surface includes at least one of: an image, print, indicia, graphics, fresnel lens, lenticular lens, color, an embossed area, a debossed area, and a coating.

11. The facial tissue container of claim 7 a windowing material connected to a plurality of the top face portions, the windowing material spanning the facial tissue container opening.

12. The facial tissue container of claim 7 in combination with a plurality of facial tissues.

13. The facial tissue container of claim 7 further comprising a removable perforated portion that covers at least a portion of the facial tissue container opening.

14. The facial tissue container of claim 7 wherein the facial tissue container opening is oval-shaped.

15. The facial tissue container of claim 7 wherein the facial tissue container opening is substantially rectangular-shaped.

16. The facial tissue container of claim 7 wherein the container defines a rectangular polyhedral body.

17. A blank for construction of a facial tissue container, the blank comprising:

a first section having a first section decorative portion, a top flap portion disposed at a first end of the first section decorative portion and a bottom flap portion disposed at a second end of the first section decorative portion;

a second section connected to the first section, the second section having a second section decorative portion, a top flap portion disposed at a first end of the second section decorative portion and a bottom flap portion disposed at a second end of the second section decorative portion;

a third section connected to the second section, the third section having a third section decorative portion, a top flap portion disposed at a first end of the third section decorative portion and a bottom flap portion disposed at a second end of the third section decorative portion;

a fourth section connected to the third section, the fourth section having a fourth section decorative portion, a top flap portion disposed at a first end of the fourth section decorative portion and a bottom flap portion disposed at a second end of the fourth section decorative portion; and and a tab portion connected to a third end of the fourth section decorative portion;

wherein the first, second, third and fourth section decorative portions form a continuous decorative surface.

18. The blank of claim 17 further comprising a removable perforated portion.

19. The blank of claim 17 wherein the first section top flap portion and the third section top flap portion are truncated triangular.

20. The blank of claim 17 wherein the first section top flap portion and the third section top flap portion are notched truncated triangular.

21. The blank of claim 17 wherein the second section top flap portion and the fourth section top flap portion are rectangular and further include a slot.

22. The blank of claim 17 wherein the second section top flap portion and the fourth section top flap portion are rectangular and further include a double-notched edge.

* * * * *